US012551776B2

(12) United States Patent
Tseng

(10) Patent No.: US 12,551,776 B2
(45) Date of Patent: Feb. 17, 2026

(54) SYSTEM FOR PICKING CARDS AND IDENTIFICATION FOR A CARD GAME

(71) Applicant: Bingotimes Digital Technology Co., Ltd., Taichung (TW)

(72) Inventor: Kuo-Lung Tseng, Taichung (TW)

(73) Assignee: Bingotimes Digital Technology Co., Ltd., Taichung (TW)

( * ) Notice: Subject to any disclaimer, the term of this patent is extended or adjusted under 35 U.S.C. 154(b) by 560 days.

(21) Appl. No.: 18/139,344

(22) Filed: Apr. 25, 2023

(65) Prior Publication Data

US 2024/0359086 A1 Oct. 31, 2024

(51) Int. Cl.

| | |
|---|---|
| ***A63F 1/12*** | (2006.01) |
| ***A63F 1/06*** | (2006.01) |
| ***B65H 3/08*** | (2006.01) |

(52) U.S. Cl.

CPC ..... *A63F 1/12* (2013.01); *A63F 1/067* (2013.01); *B65H 3/0816* (2013.01); *B65H 2511/413* (2013.01)

(58) Field of Classification Search

CPC ..... A63F 1/12; A63F 1/14; A63F 1/067

See application file for complete search history.

(56) References Cited

U.S. PATENT DOCUMENTS

| | | | | |
|---|---|---|---|---|
| 8,444,148 | B1 * | 5/2013 | Tseng | A63F 1/12 273/309 |
| 9,782,901 | B1 * | 10/2017 | Lo | B25J 15/0683 |
| 9,878,232 | B1 * | 1/2018 | Tseng | A63F 9/30 |
| 2012/0319351 | A1 * | 12/2012 | Tseng | A63F 1/14 273/149 R |
| 2013/0106054 | A1 * | 5/2013 | Tseng | A63F 1/12 273/149 R |
| 2017/0182401 | A1 * | 6/2017 | Hsu | A63F 1/14 |

FOREIGN PATENT DOCUMENTS

| | | | |
|---|---|---|---|
| TW | I603767 B | * | 11/2017 |
| TW | I849806 B | * | 7/2024 |

* cited by examiner

*Primary Examiner* — Kristen C Hayes
(74) *Attorney, Agent, or Firm* — Che-Yang Chen

(57) ABSTRACT

A system for picking cards and identification for a card game includes a robot arm, a shuffling machine, a front identification module, and a rear identification module. The plate body has a low front plate and a high rear plate. The low front plate is provided with a front suction cup assembly. The high rear plate is provided with a rear suction cup assembly. With the above system, when the front suction cup assembly picks the playing card, the rear suction cup assembly will not touch the shuffling machine. While the playing card sucked by the front suction cup assembly is identified, the rear suction cup assembly picks the playing card. While the playing card sucked by the rear suction cup assembly is identified, the front suction cup assembly picks the playing card. This can reduce procedural actions and speed up game progression.

5 Claims, 9 Drawing Sheets

SYSTEM FOR PICKING CARDS AND IDENTIFICATION FOR A CARD GAME

BACKGROUND OF THE PRESENT INVENTION

Field of Invention

The present invention relates to a system for picking cards and identification for a card game. The system comprises a robot arm connected with a plate body. The plate body has a plurality of suction cups that are different in height and arranged in sequence, so that the suction cups will not be hindered for picking playing cards in a shuffling machine. The shuffling machine is equipped with a front identification module and a rear identification module. The robot arm can pick the playing cards to identify the suit and the numeral of the playing cards simultaneously, so as to reduce procedural actions and speed up game progression.

Description of Related Arts

In general, a robotic arm is used for playing a card game. As disclosed in Taiwan Patent Publication No. I411461, titled "DISPLAY DEVICE FOR DEALING PLAYING CARDS FAST IN CARD GAME", the robot arm is provided with a plate body. The plate body is provided with a plurality of suction cups. When the playing cards are dealt, the robot arm moves the suction cups in the banker area and the player area to suck the playing cards in sequence and move the plate body to face the players for displaying the sucked playing cards. Therefore, the deal procedure to pick and display the playing cards can be completed quickly. As shown in FIG. 1, because the riffling mechanism 11 of a conventional shuffling machine 10 is equipped with a card removal structure and has multiple additional functions, the structure is relatively large. The depth for picking the playing cards from the central compartment 12 of the shuffling machine 10 is relatively deep. In the foregoing display device for dealing playing cards, when the front row suction cups 15 of the plate body 14 of the robot arm 13 go deep into the central compartment 12 of the shuffling machine 10 to suck the playing cards 1, the rear row suction cups 15 of the plate body 14 will touch the riffling mechanism 11 of the shuffling machine 10. As a result, the robot arm 13 cannot complete the operation to pick the playing cards. Furthermore, in the card game, after one playing card is picked by the plate body 14, it is necessary to identify the suit and the numeral of the playing card for the computer to record the suit and the numeral of the playing card and calculate the odds. That is, after the suction cup 15 of the plate body 14 picks a first playing card, the robot arm 13 moves the first playing card to the photographic identifier 16 for identifying the suit and the numeral of the first playing card. Next, a second playing card is picked and moved to the photographic identifier 16 for identification. This action is repeated in order. The above-mentioned steps of picking playing cards and identification are repetitive and time-consuming. In other words, picking five playing cards needs the action of identification by the photographic identifier 16 five times. The card game cannot go fast, so the player may be impatient at the card game.

SUMMARY OF THE PRESENT INVENTION

The primary object of the present invention is to solve the aforesaid problems and to provide a system for picking cards and identification for a card game. The system comprises a robot arm with a plate body having a low front plate and a high rear plate. The low front plate has a front suction cup assembly. The high rear plate has a rear suction cup assembly. When the front suction cup assembly picks the playing card, the rear suction cup assembly will not touch the shuffling machine. A front identification module is provided in front of the shuffling machine, and a rear identification module is provided behind the shuffling machine. While the playing card sucked by the front suction cup assembly is identified, the rear suction cup assembly picks the playing card. While the playing card sucked by the rear suction cup assembly is identified, the front suction cup assembly picks the playing card. This can reduce procedural actions and speed up game progression.

In order to achieve the foregoing object, a system for picking cards and identification for a card game is provided. The system comprises a robot arm, a shuffling machine, a front identification module, and a rear identification module. The robot arm is disposed on a tabletop. A plate body is connected to the robot arm. The plate body has a low front plate and a high rear plate. The low front plate is lower in height than the high rear plate. The plate body is provided with a plurality of suction cups. The suction cups are arranged in two rows and divided into a front suction cup assembly located on the low front plate and a rear suction cup assembly located on the high rear plate. The front suction cup assembly and the rear suction cup assembly are parallel. The shuffling machine is disposed on the tabletop. An upper edge of the shuffling machine is higher than the tabletop. The shuffling machine has a left compartment, a central compartment and a right compartment that are arranged in sequence in a front section of the shuffling machine. A riffling mechanism is disposed on a rear section of the shuffling machine. The suction cups are configured to suck at least one deck of playing cards in the central compartment. Every adjacent two of the suction cups of the front suction cup assembly or every adjacent two of the suction cups of the rear suction cup assembly correspond in position to the central compartment, the left compartment and the right compartment. The front identification module is disposed on the tabletop in front of the shuffling machine. The front identification module is configured to identify the playing cards sucked by the suction cups of the front suction cup assembly while the rear suction cup assembly picks the playing cards in the central compartment. The rear identification module is disposed on the tabletop beside the riffling mechanism. The rear identification module is configured to identify the playing cards sucked by the suction cups of the rear suction cup assembly while the front suction cup assembly picks the playing cards in the central compartment.

In one embodiment of the present invention, the front suction cup assembly and the rear suction cup assembly are symmetrically arranged. The front identification module is disposed on the tabletop in front of the central compartment of the shuffling machine. The rear identification module is disposed on the tabletop behind the left compartment.

In one embodiment of the present invention, the plate body has a transverse stepped portion for the plate body to form the low front plate and the high rear plate.

In one embodiment of the present invention, the upper edge of the shuffling machine is higher than the tabletop by a predetermined height. The predetermined height is greater than a depth at which the suction cups extend into the central compartment to pick the playing cards.

In one embodiment of the present invention, the suction cups of the front suction cup assembly are equally spaced, and the suction cups of the rear suction cup assembly are equally spaced.

With the above system, when the front suction cup assembly picks the playing card, the rear suction cup assembly will not touch the shuffling machine. While the playing card sucked by the suction cup of the low front plate is identified, the suction cup of the high rear plate picks the playing card. While the playing card sucked by the suction cup of the high rear plate is identified, the suction cup of the low front plate picks the playing card. This can reduce procedural actions and speed up game progression.

DETAILED DESCRIPTION OF THE PREFERRED EMBODIMENT

Figure 1:
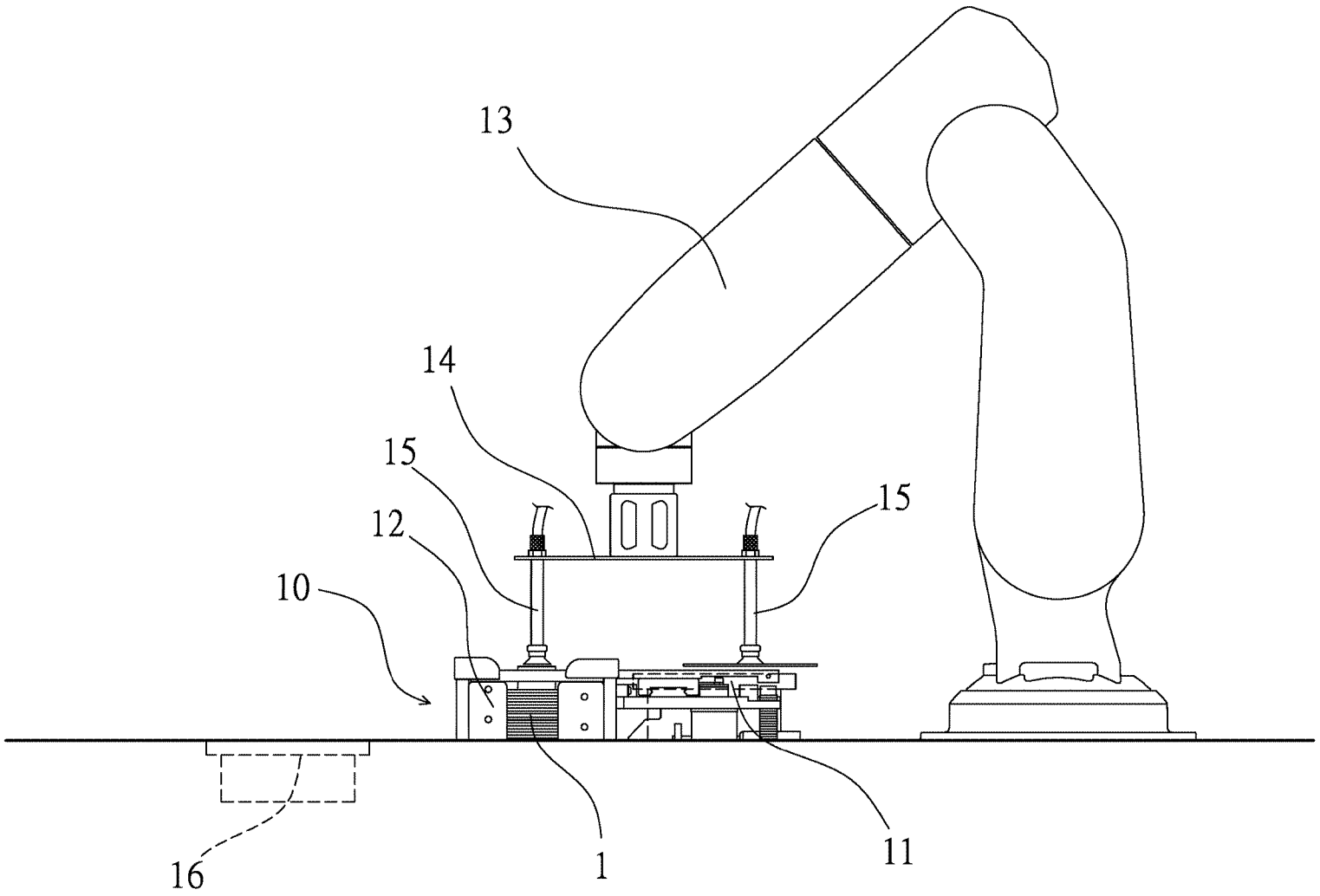
FIG. 1 PRIOR ART
FIG. 1 is a schematic view of the prior art.
Figure 2:
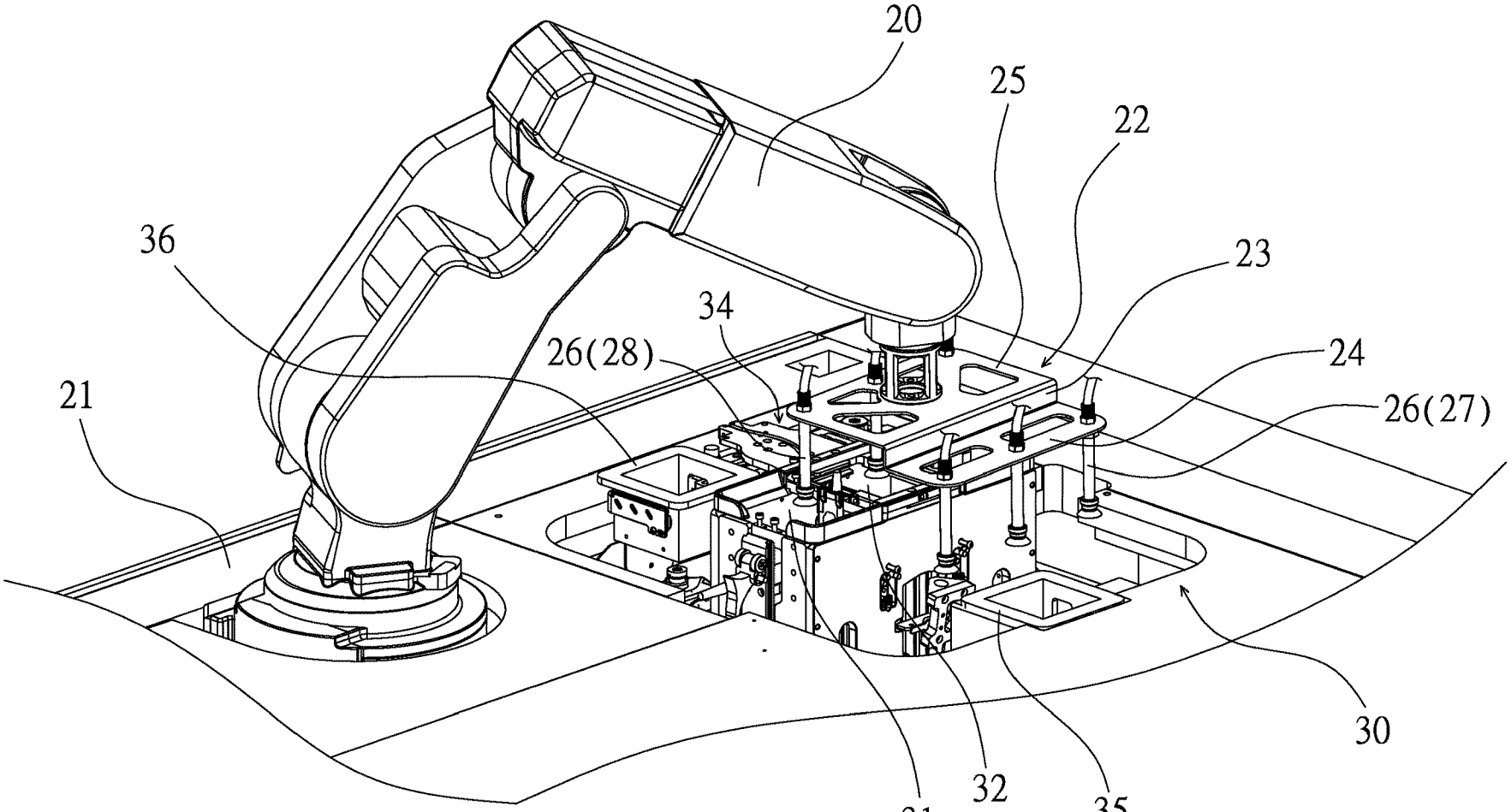
FIG. 2 is a perspective view of the present invention.
Figure 3:
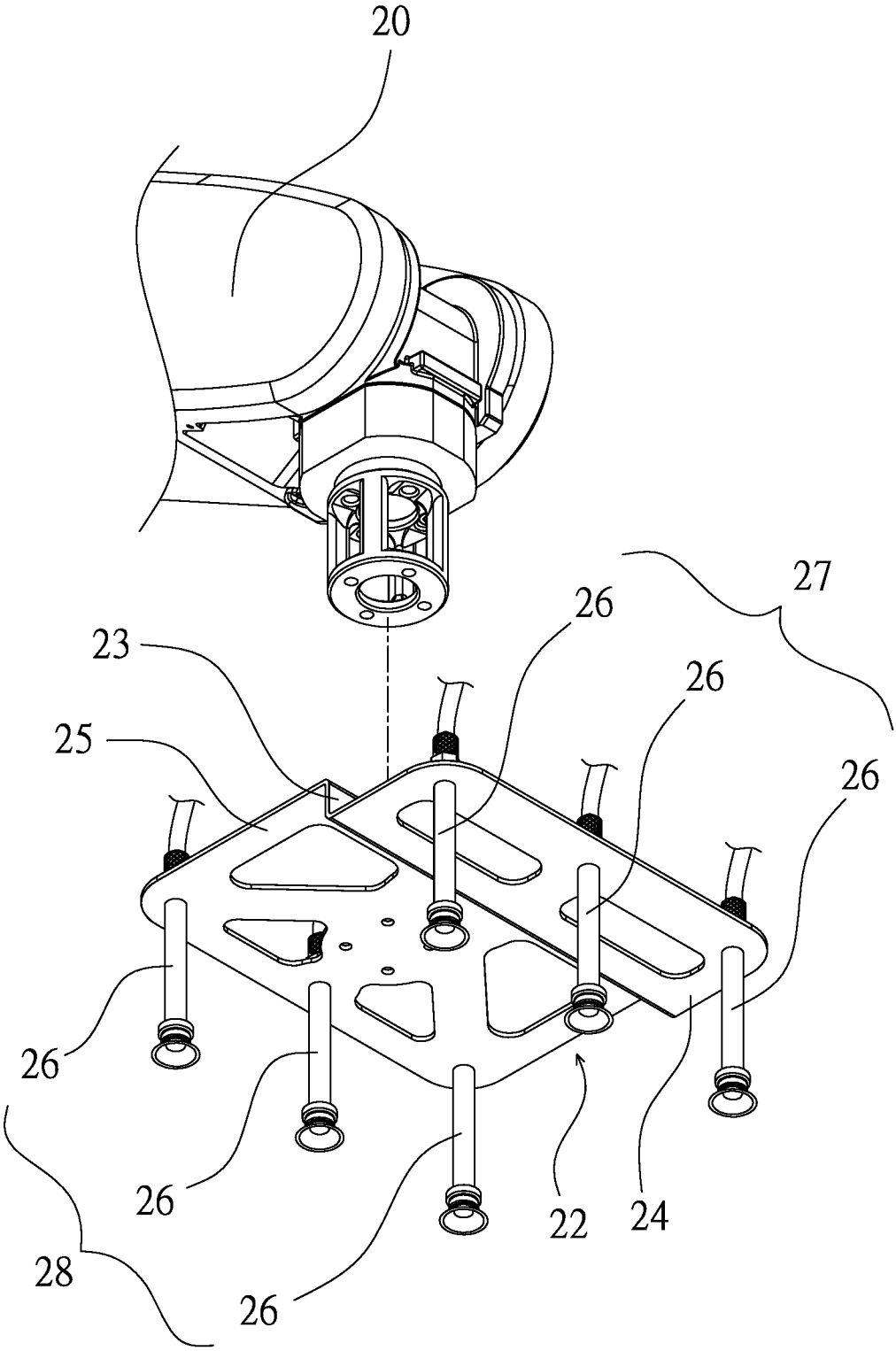
FIG. 3 is a bottom perspective view of the plate body of the present invention.

Embodiments of the present invention will now be described, by way of example only, with reference to the accompanying drawings.

As shown in FIGS. 2 to 9, the present invention discloses a system for picking cards and identification for a card game. The system comprises a robot arm 20, a shuffling machine 30, a front identification module 35, and a rear identification module 36.

The robot arm 20 is disposed on a tabletop 21. A plate body 22 is connected to the front end of the robot arm 20. The plate body 22 has a transverse stepped portion 23, so that the plate body 22 is divided into a low front plate 24 and a high rear plate 25. The plate body 22 is provided with a plurality of suction cups 26 for sucking playing cards 1. The suction cups 26 are arranged in two rows and divided into a front suction cup assembly 27 located on the low front plate 24 and a rear suction cup assembly 28 located on the high rear plate 25. The front suction cup assembly 27 and the rear suction cup assembly 28 are parallel and symmetrically arranged.

The shuffling machine 30 is disposed on the tabletop 21. The upper edge of the shuffling machine 30 is higher than the tabletop 21. The shuffling machine 30 has a left compartment 31, a central compartment 32 and a right compartment 33 that are arranged in sequence in a front section of the shuffling machine 30. A riffling mechanism 34 is disposed on a rear section of the shuffling machine 30. When in use, the riffling mechanism 34 slides left and right to move the playing cards 1 in the central compartment 32 to the left compartment 31 or the right compartment 33, and the playing cards 1 are shuffled randomly and stacked in the central compartment 32, and the suction cups 26 of the robotic arm 20 suck the playing cards 1 in the central compartment 32.

The front identification module 35 is disposed on the tabletop 21 in front of the central compartment 32. The front identification module 35 is configured to identify the suit and the numeral of the playing card sucked by the suction cups 26 of the front suction cup assembly 27.

The rear identification module 36 is disposed on the tabletop 21 behind the left compartment 31. The rear identification module 36 is configured to identify the suit and the numeral of the playing card sucked by the suction cups 26 of the rear suction cup assembly 28.

With the above system, when the suction cups 26 of the low front plate 24 picks the playing cards, the suction cups 26 of the high rear plate 25 will not touch the riffling mechanism 34 of the shuffling machine 30. While the playing card sucked by the suction cup 26 of the low front plate 24 is identified, the suction cup 26 of the high rear plate 25 picks the playing card. While the playing card sucked by the suction cup 26 of the high rear plate 25 is identified, the suction cup 26 of the low front plate 24 picks the playing card. This can reduce procedural actions and speed up game progression.

Figure 4:
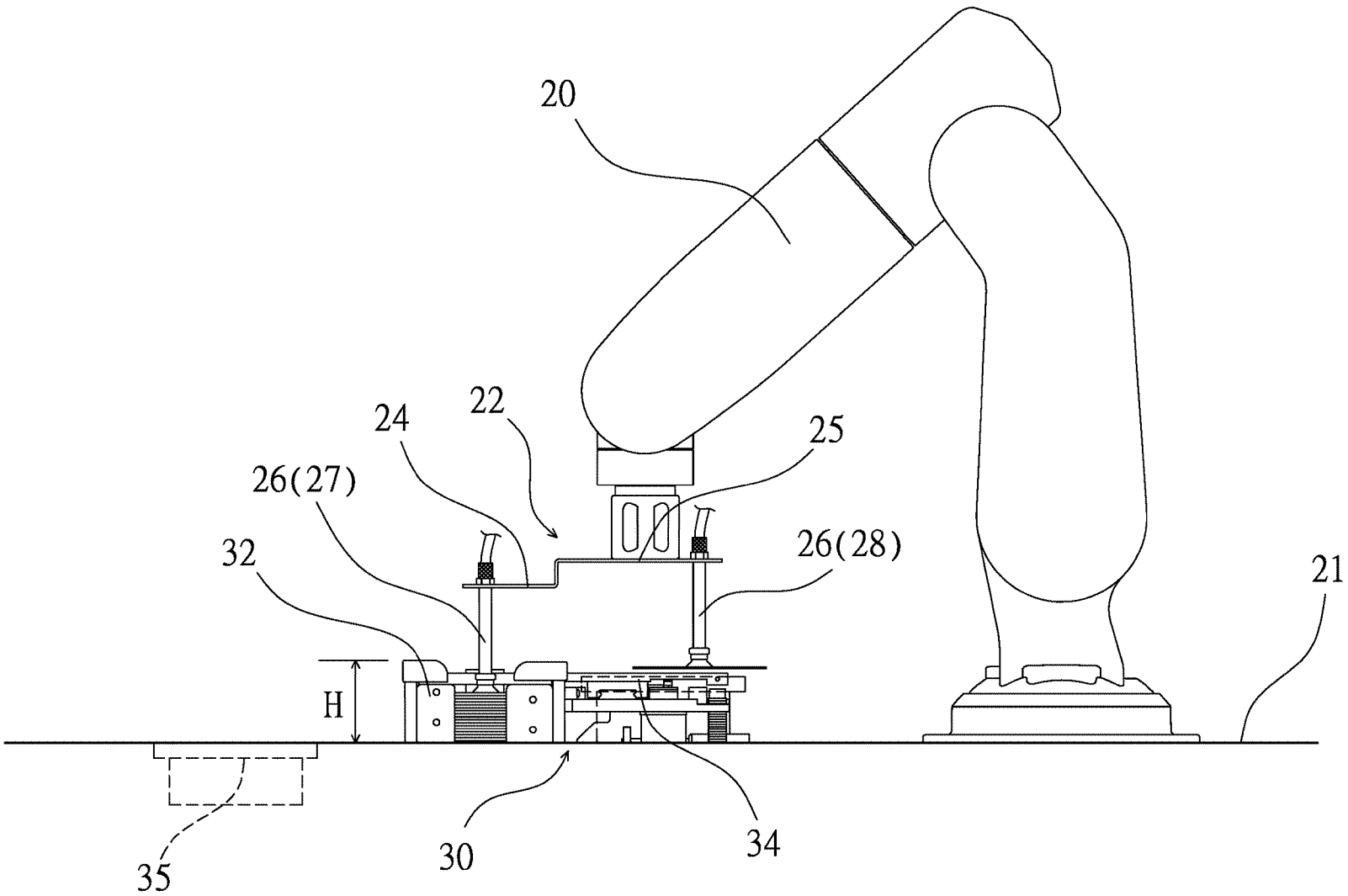
FIG. 4 is a planar schematic view of the present invention.

The assembly, function and effect of the present invention are described in detail below. As shown in FIGS. 2 to 9, the plate body 22 of the present invention has a height difference, that is, the suction cup assembly 27 on the low front plate 24 is lower in height than the suction cup assembly 28 on the high rear plate 25, such that the suction cups 26 of the front suction cup assembly 27 can go deeper into the central compartment 32 of the shuffling machine 30 for picking the playing card, and the suction cups 26 of the rear suction cup assembly 28 will not touch or interfere with the riffling mechanism 34 of the shuffling machine 30, as shown in FIG. 4. The upper edge of the shuffling machine 30 is higher than the tabletop 21 by a predetermined height H. The predetermined height H is greater than the depth at which the suction cups 26 extend into the central compartment 32 to pick the playing cards. The suction cups 26 of the front suction cup assembly 27 are equally spaced, and the suction cups 26 of the rear suction cup assembly 28 are equally spaced. Every adjacent two of the suction cups 26 of the front suction cup assembly 27 or every adjacent two of the suction cups 26 of the rear suction cup assembly 28 correspond in position to the central compartment 32, the left compartment 31 and the right compartment 33, such that the suction cups 26 can extend into the central compartment 32, the left compartment 31 and the right compartment 33 at any position, or extend out of the shuffling machine 30, without interference or hindrance.

Figure 5:
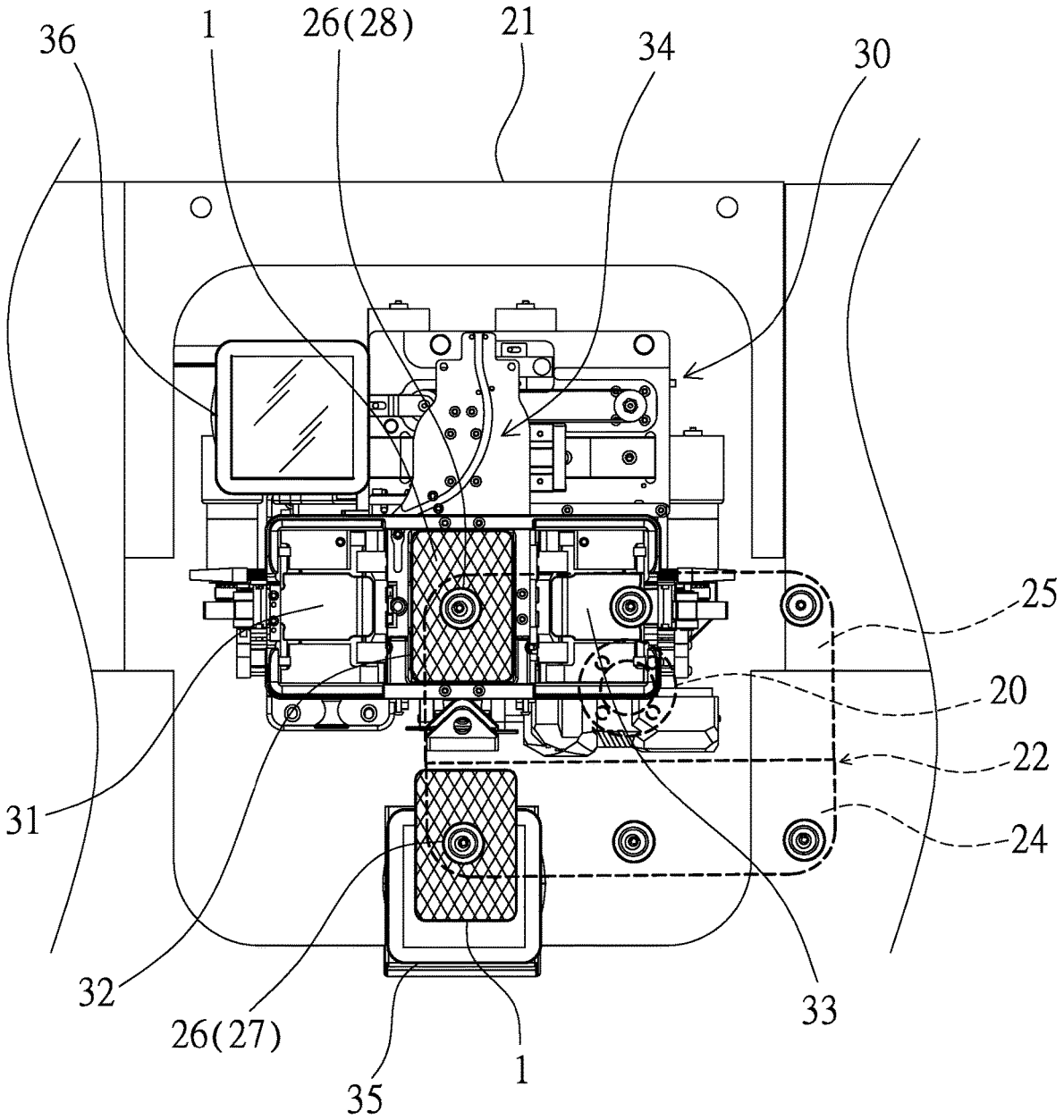
FIG. 5 is a top schematic view of the present invention, wherein the first and second suction cups pick the playing cards for identification.
Figure 6:
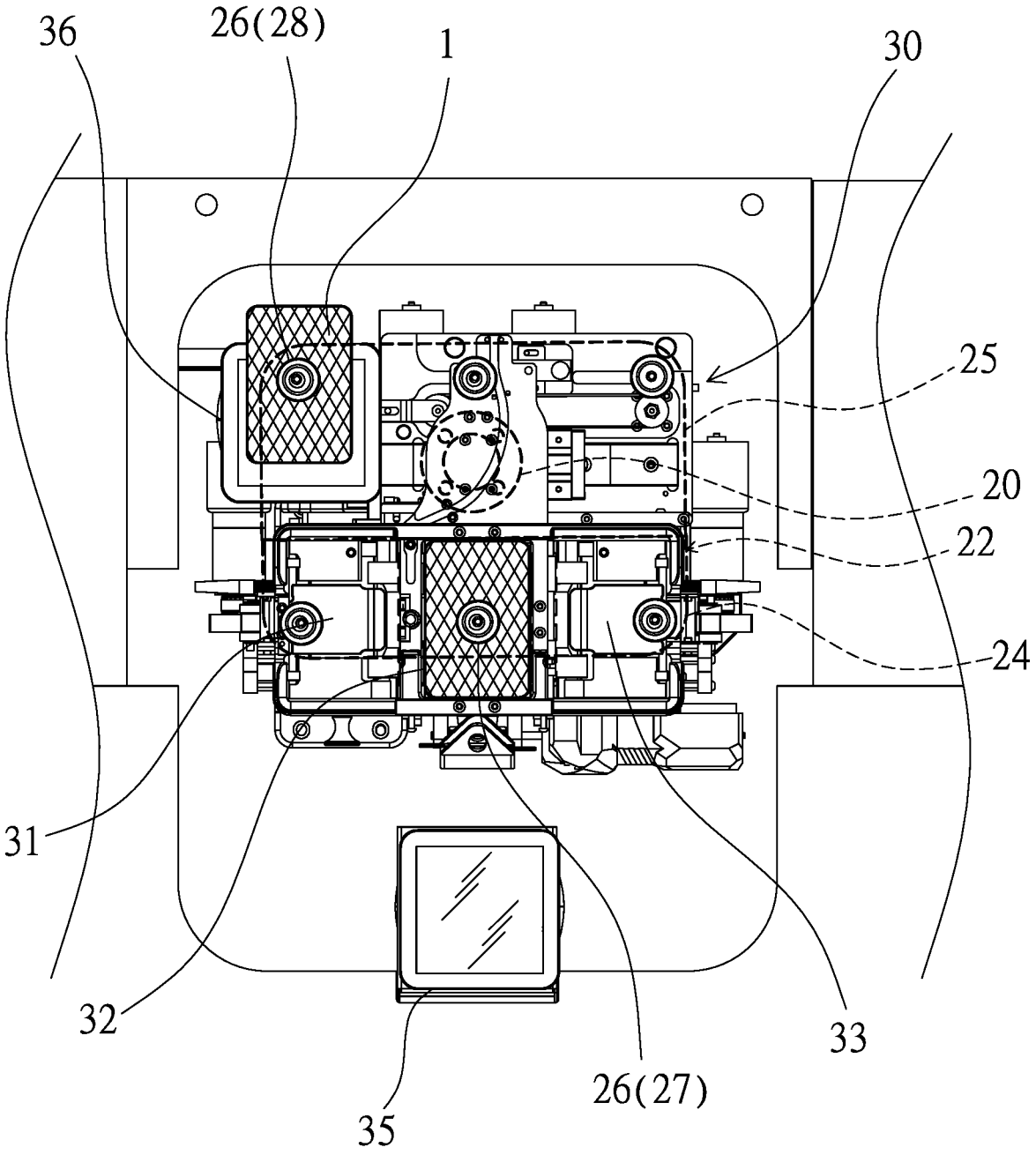
FIG. 6 is a top schematic view of the present invention, wherein the second and third suction cups pick the playing cards for identification.
Figure 7:
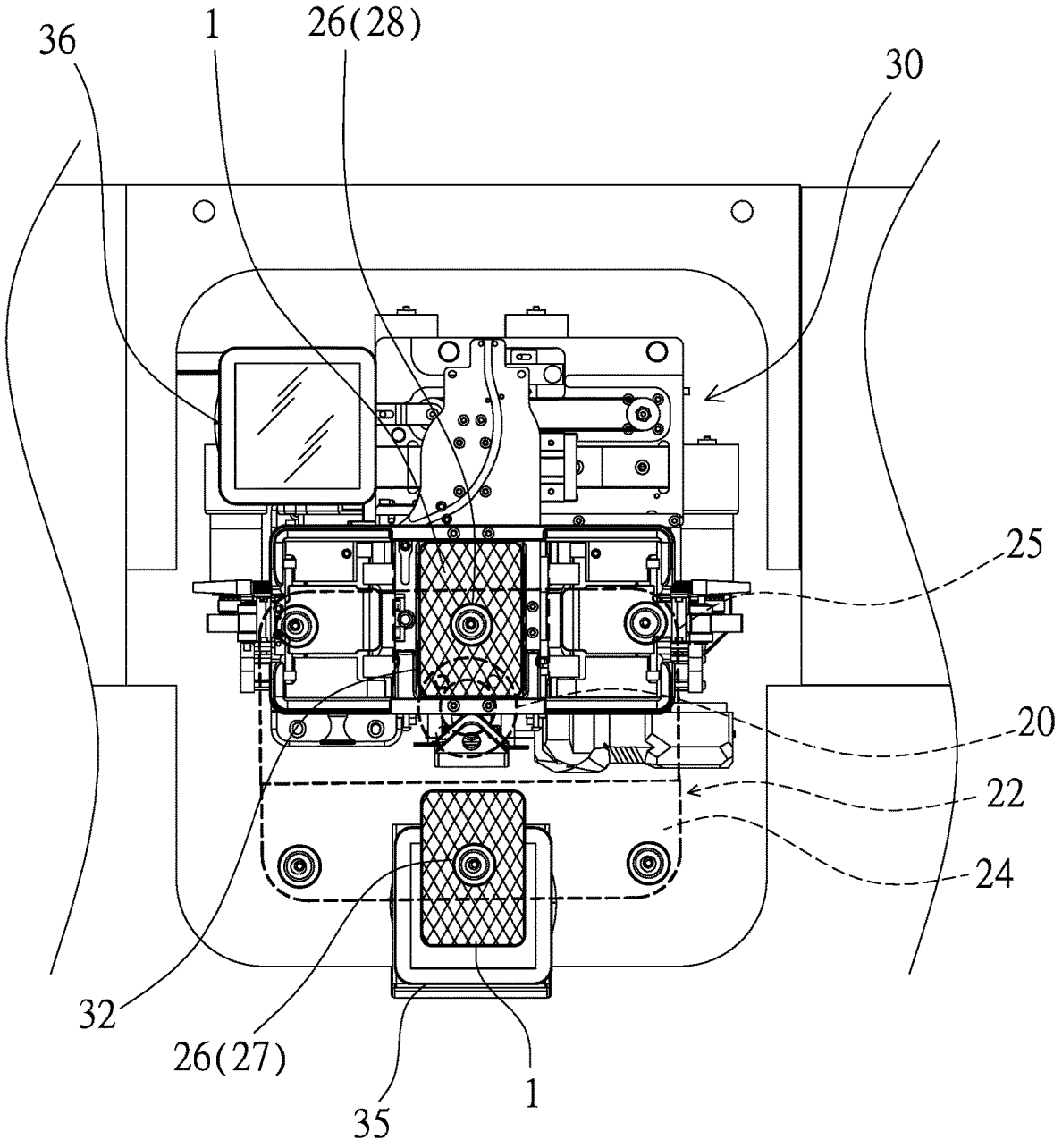
FIG. 7 is a top schematic view of the present invention, wherein the third and fourth suction cups pick the playing cards for identification.
Figure 8:
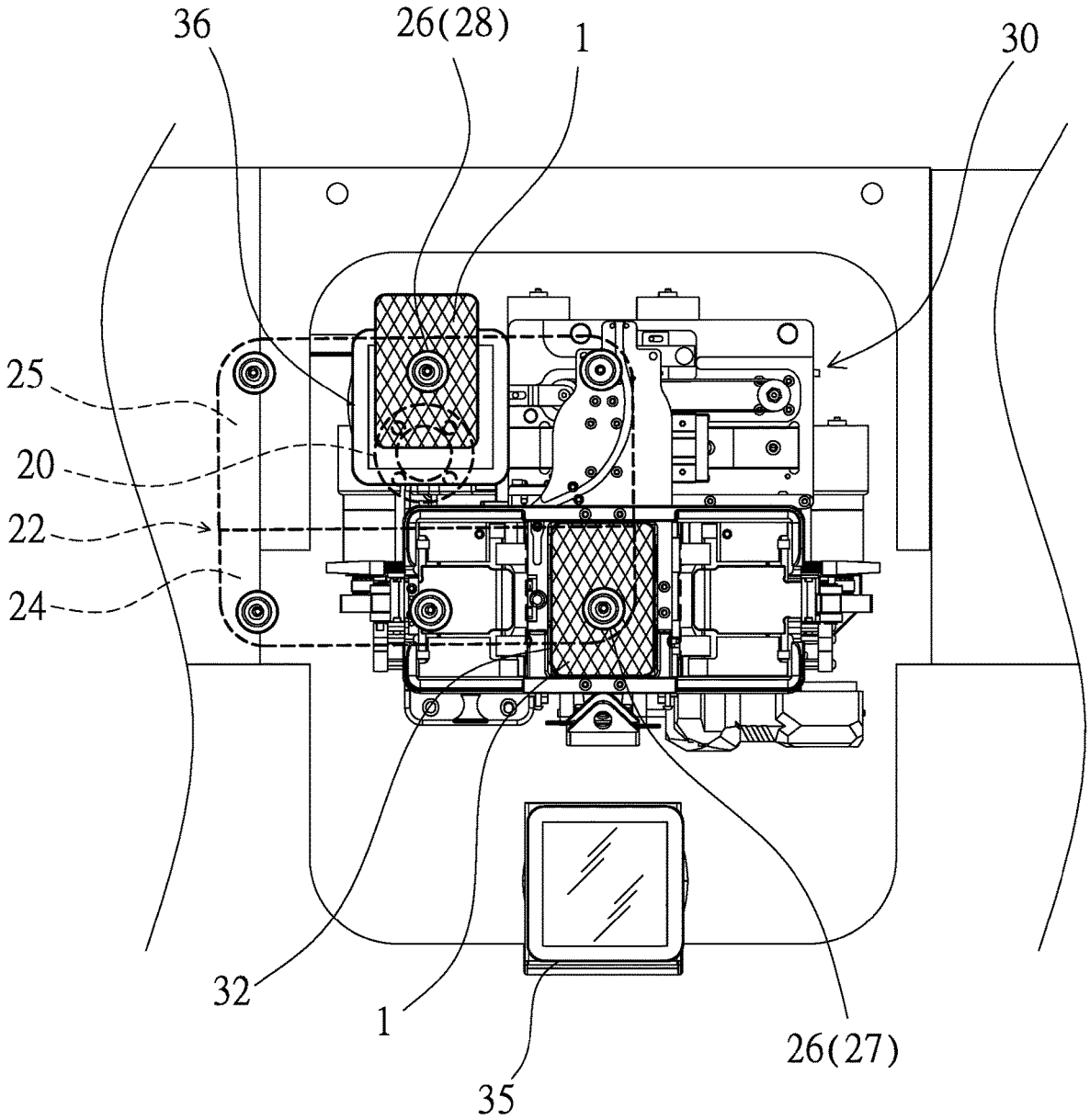
FIG. 8 is a top schematic view of the present invention, wherein the fourth and fifth suction cups pick the playing cards for identification.
Figure 9:
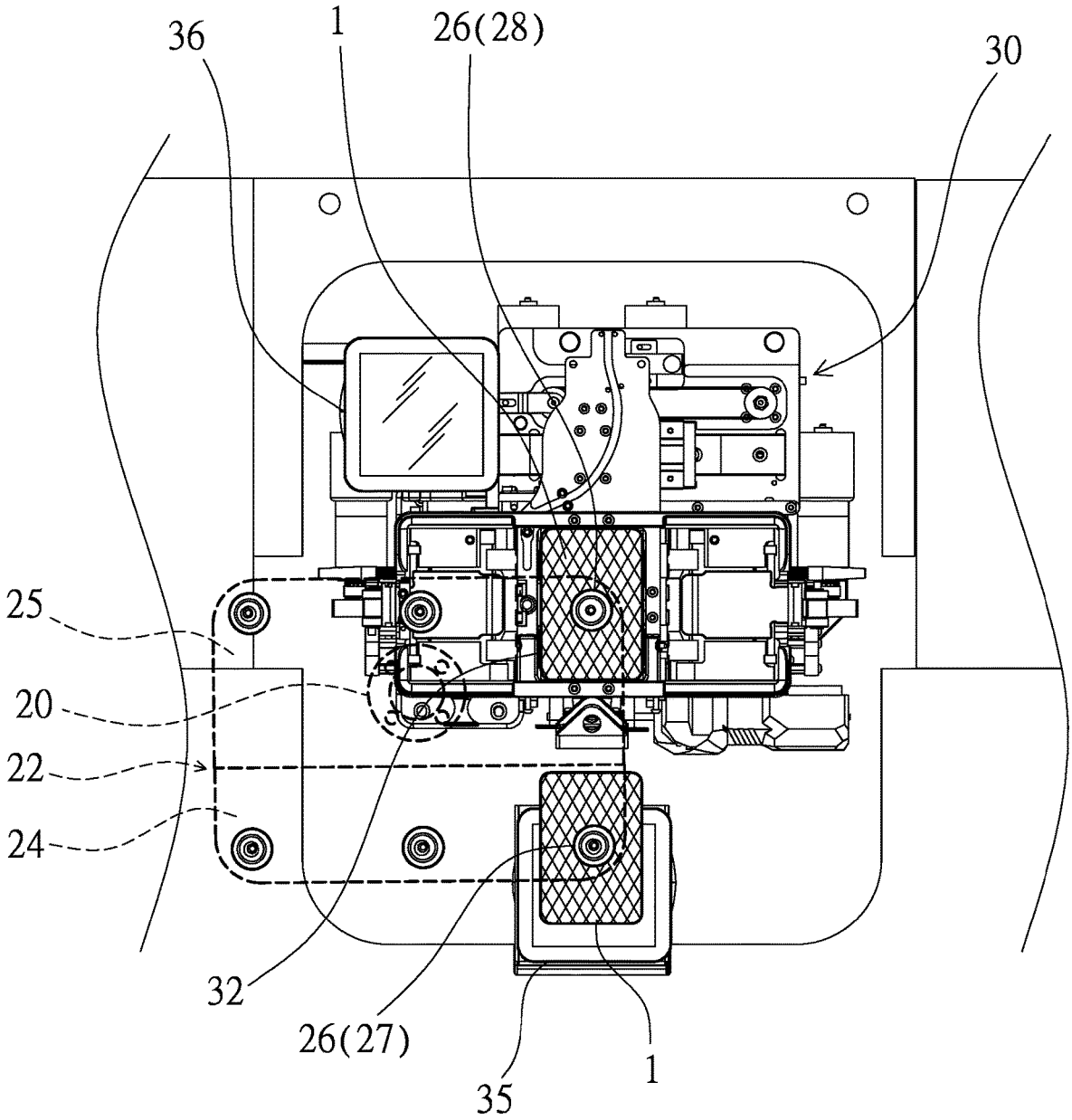
FIG. 9 is a top schematic view of the present invention, wherein the fifth and sixth suction cups pick the playing cards for identification.

Furthermore, the plate body 22 of this embodiment is provided with six suction cups 26 as an example, but not limited thereto. The suction cups 26 of the front suction cup assembly 27 are defined as the first, third and fifth suction cups 26 from left to right. The suction cups 26 of the rear suction cup assembly 28 are defined as the second, fourth and sixth suction cups 26 from left to right. If Baccarat is taken as an example, referring to FIG. 5 and FIG. 6, the robot arm 20 moves the first suction cup 26 of the lower front plate 24 into the central compartment 32 to suck one first playing card (banker) to the front identification module 35 for identifying the suit and the numeral of the sucked playing card (as shown in FIG. 5). At the same time, the second suction cup 26 of the high rear plate 25 is just at the position of the central compartment 32. When the first suction cup 26 is moved down for identifying the playing card, the second suction cup 26 of the high rear plate 25 sucks a second playing card (player). Then, the robotic arm 20 moves the second suction cup 26 to the rear identification module 36 to identify the suit and the numeral of the second playing card (as shown in FIG. 6). At the same time, the third suction cup 26 of the lower front plate 24 is just at the position of the central compartment 32. When the second suction cup 26 is moved down for identifying the second playing card, the third suction cup 26 of the lower front plate 24 sucks a third playing card (banker). Then, the robotic arm 20 moves the third suction cup 26 to the front identification module 35 to identify the suit and the numeral of the third playing card (as shown in FIG. 7). At the same time, the fourth suction cup 26 of the high rear plate 25 is just at the position of the central compartment 32. When the third suction cup 26 is moved down for identifying the third playing card, the fourth suction cup 26 of the high rear plate 25 sucks a fourth playing card (player). Next, the robotic arm 20 moves the fourth suction cup 26 to the rear identification module 36 to identify the suit and the numeral of the fourth playing card (as shown in FIG. 8). If necessary, the fifth suction cup 26 of the low front plate 24, the sixth suction cup 26 of the high rear plate 25, and so on, can continue to pick the playing cards and identify the playing cards simultaneously (as shown in FIG. 9). Once the banker and the players each get one playing card according to the rules of Baccarat, the outcome of the game is obtained. The robot arm 20 raises the plate body 22 at an angle to display the playing cards for the players to verify the playing cards.

From the above description, the system of the present invention may be applied to various shuffling machines with more functions. When the plate body 22 having the suction cups 26 is to pick playing cards, the suction cups 26 and the shuffling machine 30 will not interfere with each other. The procedures of picking, dealing and identifying the playing cards can be carried out simultaneously. The operation is simplified. The game progresses quickly, so the players won't be impatient to wait for the playing cards.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A system for picking cards and identification for a card game, comprising:

a robot arm, disposed on a tabletop, a plate body being connected to the robot arm, the plate body having a low front plate and a high rear plate, the low front plate being lower in height than the high rear plate; the plate body being provided with a plurality of suction cups, the suction cups being arranged in two rows and divided into a front suction cup assembly located on the low front plate and a rear suction cup assembly located on the high rear plate, the front suction cup assembly and the rear suction cup assembly being parallel;

a shuffling machine, disposed on the tabletop, an upper edge of the shuffling machine being higher than the tabletop, the shuffling machine having a left compartment, a central compartment and a right compartment that are arranged in sequence in a front section of the shuffling machine, a riffling mechanism being disposed on a rear section of the shuffling machine, the suction cups being configured to suck at least one deck of playing cards in the central compartment, every adjacent two of the suction cups of the front suction cup assembly or every adjacent two of the suction cups of the rear suction cup assembly corresponding in position to the central compartment, the left compartment and the right compartment;

a front identification module, disposed on the tabletop in front of the shuffling machine, the front identification module being configured to identify the playing cards sucked by the suction cups of the front suction cup assembly while the rear suction cup assembly picks the playing cards in the central compartment;

a rear identification module, disposed on the tabletop beside the riffling mechanism, the rear identification module being configured to identify the playing cards sucked by the suction cups of the rear suction cup assembly while the front suction cup assembly picks the playing cards in the central compartment.

2. The system as claimed in claim 1, wherein the front suction cup assembly and the rear suction cup assembly are symmetrically arranged, the front identification module is disposed on the tabletop in front of the central compartment of the shuffling machine, and the rear identification module is disposed on the tabletop behind the left compartment.

3. The system as claimed in claim 1, wherein the plate body has a transverse stepped portion for the plate body to form the low front plate and the high rear plate.

4. The system as claimed in claim 1, wherein the upper edge of the shuffling machine is higher than the tabletop by a predetermined height, and the predetermined height is greater than a depth at which the suction cups extend into the central compartment to pick the playing cards.

5. The system as claimed in claim 1, wherein the suction cups of the front suction cup assembly are equally spaced, and the suction cups of the rear suction cup assembly are equally spaced.

* * * * *